United States Patent [19]

Leweke et al.

[11] Patent Number: 4,578,971

[45] Date of Patent: Apr. 1, 1986

[54] MACHINE FOR MANUFACTURING SPIRAL SEAM PIPING FROM STRIP METAL

[75] Inventors: Willi Leweke; Dietmar Orth, both of Dortmund, Fed. Rep. of Germany

[73] Assignee: Hoesch Aktiengesellschaft, Fed. Rep. of Germany

[21] Appl. No.: 629,802

[22] Filed: Jul. 11, 1984

[30] Foreign Application Priority Data

Jul. 20, 1983 [DE] Fed. Rep. of Germany ..... 3326050

[51] Int. Cl.[4] ..... B21C 37/12

[52] U.S. Cl. ..... 72/21; 72/49

[58] Field of Search ..... 72/21, 49, 50, 135; 228/17.7, 145, 146, 147, 151

[56] References Cited

FOREIGN PATENT DOCUMENTS

| | | | |
|---|---|---|---|
| 2053266 | 5/1972 | Fed. Rep. of Germany | 72/49 |
| 2833096 | 4/1980 | Fed. Rep. of Germany | 72/49 |
| 1448882 | 9/1976 | United Kingdom | 72/49 |
| 1479246 | 7/1977 | United Kingdom | 72/49 |
| 671896 | 7/1979 | U.S.S.R. | 72/49 |

*Primary Examiner*—E. Michael Combs
*Attorney, Agent, or Firm*—Eric P. Schellin

[57] ABSTRACT

In a machine for manufacturing spiral seam piping from strip metal, using a set of three forming rolls consisting of a large number of individual bending rollers, the bending rollers acting on the inside of the pipe being arranged on a roller carrier which is capable of adjustment, the roller carrier (22) is controlled and driven in order to tilt it laterally by the use of a parallelogram control arm system (23) with two control arms (25, 26) arranged in a first control circle plane (**24*a*) and one control arm (27) arranged in a second control circle plane (24*b*), at least one control circle adjuster (28, 29) associated with a control circle plane (24*a*, 24*b*), a link rod (31) acting in the direction of the pipe centerline (30), a lifting device (33) pivoted at the end (32) of the roller carrier (22), and a height-adjustable mounting (34) with a joint plate (36) carried in a bearing in the central portion of the roller carrier (22), a double lever (37) and a lifting device (38**).

6 Claims, 3 Drawing Figures

MACHINE FOR MANUFACTURING SPIRAL SEAM PIPING FROM STRIP METAL

BACKGROUND OF THE INVENTION

1. Field of the Invention

The invention consists of a machine for manufacturing spiral seam piping from strip metal, using a set of three forming rolls made up of a large number of bending rollers, the bending rollers acting on the inside of the pipe being arranged on an adjustable roller carrier.

2. Description of the Prior Art

A machine of this nature is already known from DE-AS No. 10 75 530.

In this machine, the roller carrier can be both displaced and tilted in the vertical plane. By tilting the roller carrier in the vertical plane, the front and rear bending rollers are evenly aligned vertically regardless of the magnitude of the vertical bending of the roller carrier.

However, the machine already known does not have any provision for any even lateral alignment of the front and rear bending rollers of the roller carrier. This leads to the front and rear bending rollers shaping the strip differently as a result of horizontal bending of the roller carrier, which has an adverse influence on the pipe diameter tolerance.

The invention is based on the need to design a machine of the kind mentioned at the beginning which also provides for lateral tilting of the roller carrier.

SUMMARY

The invention meets this objective by controlling and driving the roller carrier by using the following:

a parallelogram control arm system with two control arms in the first control circle plane and one control arm in a second control circle plane.

at least one control circle adjuster associated with a control circle plane;

a link rod acting in the direction of the pipe centreline;

a lifting device pivoted to one end of the roller carrier, a mounting, adjustable for height, with a joint plate carried in a bearing in the centre portion of the roller carrier, a double lever and a lifting device.

The control circle adjuster associated with the first control circle plane is fitted with two eccentric pins.

The control circle adjuster associated with the second control circle plane is fitted with one eccentric pin.

Each eccentric pin is linked to a drive motor.

The lifting devices are each equipped with a drive motor.

A control unit is provided to control the drive motors.

A measuring bar is associated with the control unit to measure the vertical and horizontal bending of the roller carrier.

BRIEF DESCRIPTION OF THE DRAWINGS

In the following description the invention is described more closely with the aid of a drawing, which shows one design example.

The figures show.

DETAILED DESCRIPTION

Figure 1:
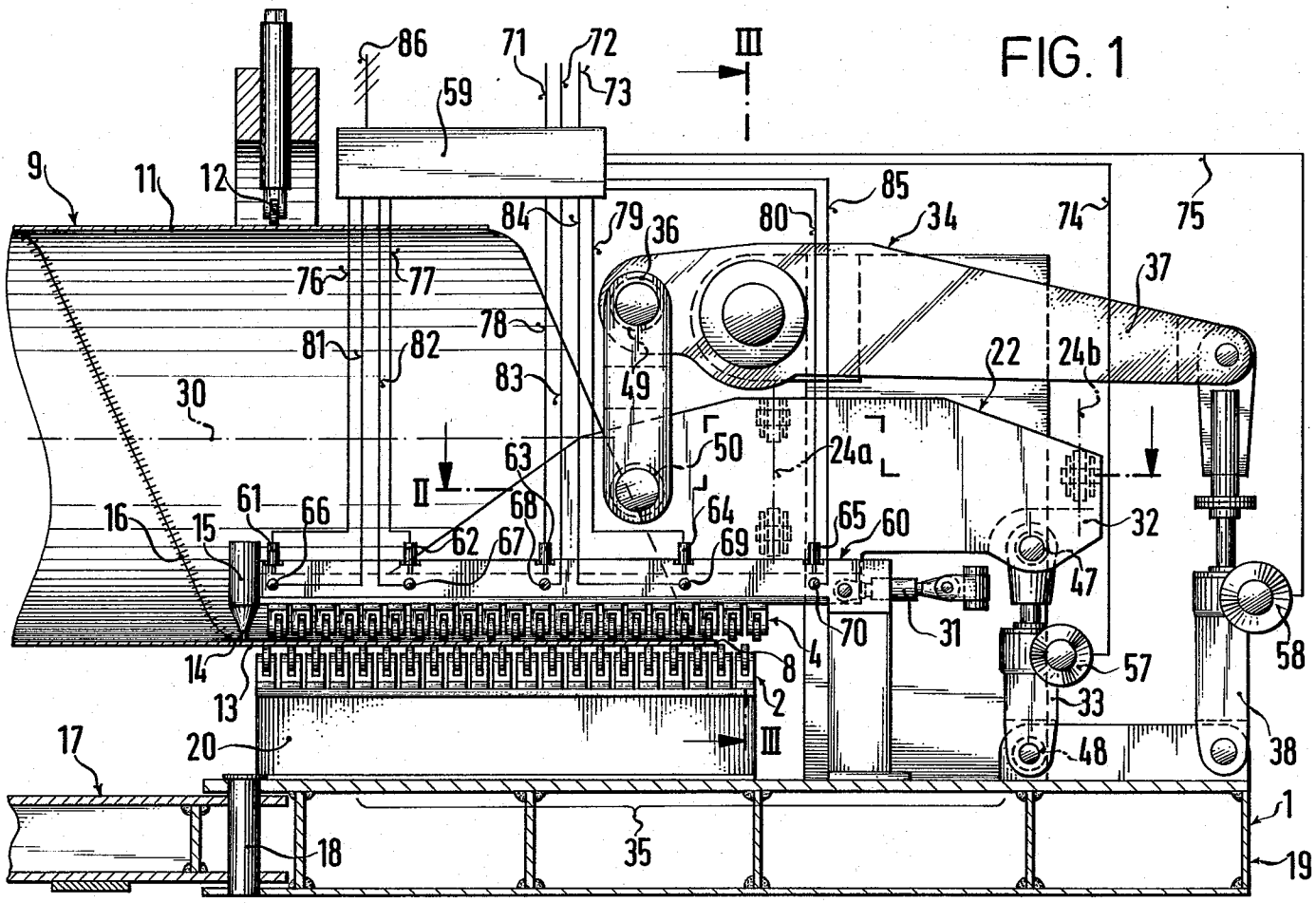
FIG. 1 a longitudinal section through a forming tool, and a section of the beginning of a pipe.
Figure 2:
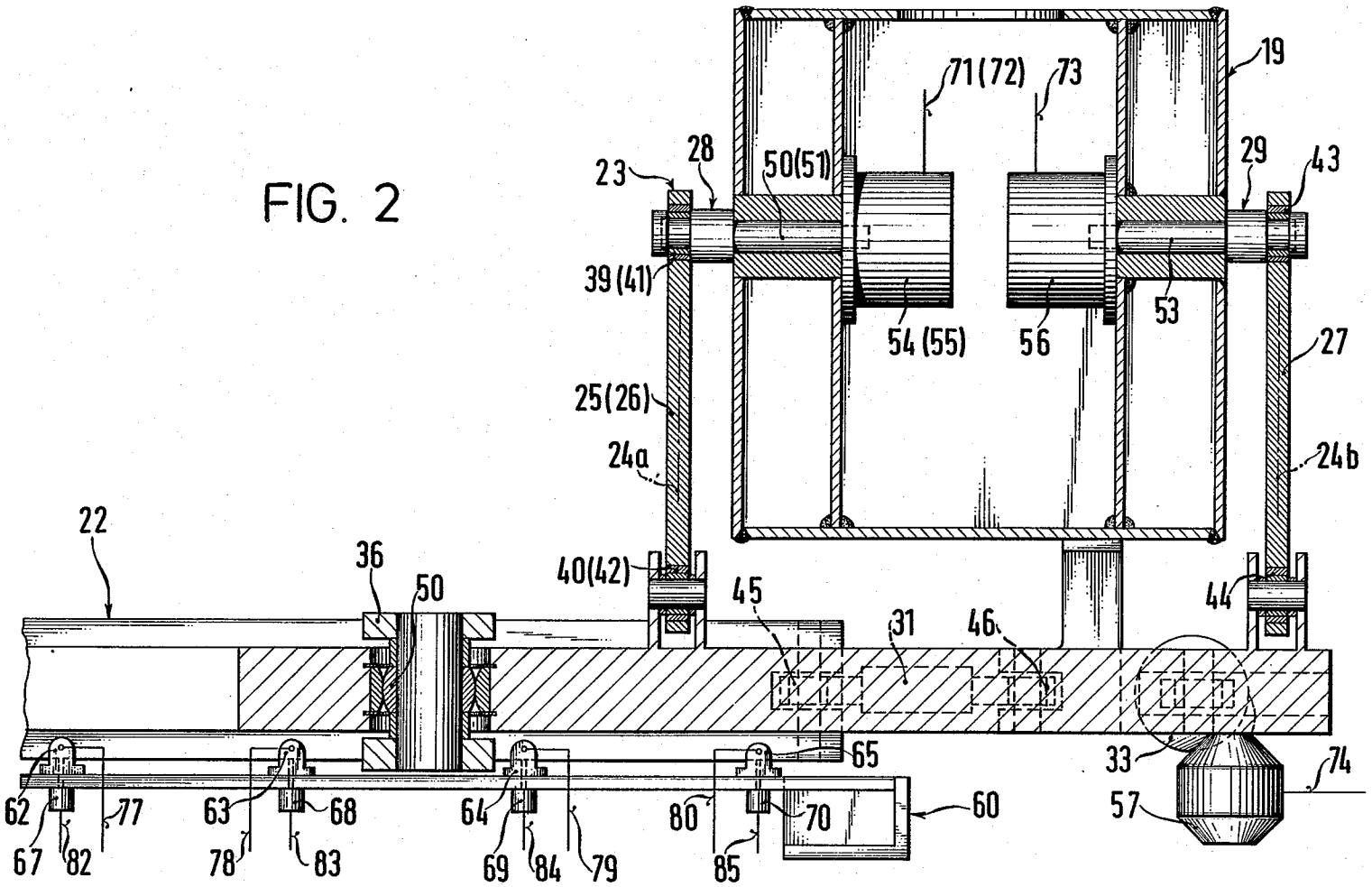
FIG. 2 a partial section through the forming tool along the line II—II in FIG. 1, to an enlarged scale.
Figure 3:
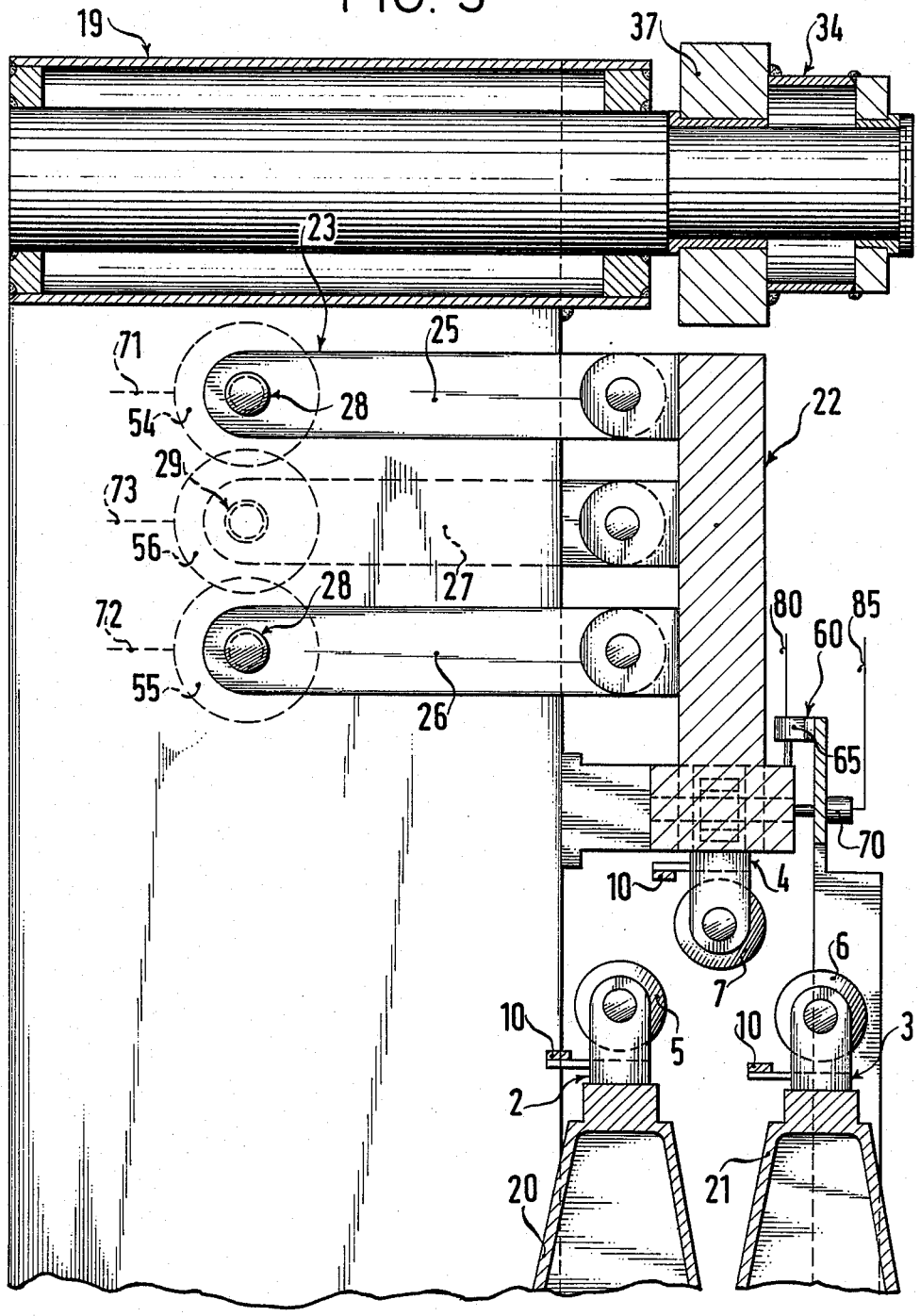
FIG. 3 a partial section along the line III—III in FIG. 1, to an enlarged scale.

A forming tool 1 is equipped with three forming rolls 2, 3 and 4, each of which contains a large number of bending rollers 5, 6 and 7. A steel strip 8 is fed in between the bending rollers 5, 6 and 7 and is continuously formed into a spiral seam pipe 9. The adjustment of the bending rollers 5, 6 and 7 to the infeed angle of the steel strip 8 as it runs in is effected with the aid of a rod 10.

To guide the beginning of the pipe 11, a number of guide rollers 12 are installed in the forming tool 1.

As the steel strip 8 is being continuously formed, the left-hand edge of the strip 13 is welded to the edge 14 of the beginning of the pipe 11. The welded joint is produced by an arc welding head 15, which makes a welding seam 16.

To control the welding gap, a pipe exit frame 17 is used, arranged so that it can swing about a vertical pin 18.

The support pedestals 20 and 21, connected to a frame 19, support the bending rollers 5 and 6. The bending rollers 7 are arranged on a roller carrier 22, which can be displaced and tilted in the vertical and horizontal planes.

To control and drive the roller carrier 22, the following are used:

a parallelogram control arm system 23 with two control arms 25 and 26 in the first control circle plane **24*a*, and one control arm 27 in a second control circle plane 24*b***;

two control circle adjusters 28 and 29, the first of which is associated with the first control circle plane **24*a* and the second of which is associated with the second control circle plane 24*b***;

a link rod 31 acting in the direction of the pipe centreline 30;

a lifting device 33 pivoted at one end 32 of the roller carrier 22; and a mounting 34, adjustable for height, with a joint plate 36 carried in a bearing in the centre portion 35 of the roller carrier 22, a double lever 37 and a lifting device 38.

The control arms 25, 26 and 27, the link rod 31, the lifting device 33 and the joint plate 36 are each fitted with two plain pivot bearings 39, 40, 41, 42, 43, 44, 45, 46, 47, 48, 49 and 50.

The control circle adjuster 28 is fitted with two eccentric pins 51 and 52. The control circle adjuster 29 is fitted with only one eccentric pin 53.

Each eccentric pin 51, 52, and 53 is fitted with a drive motor 54, 55 and 56.

Both lifting devices 33 and 38 are each fitted with a drive motor 57, and 58.

The drive motors 54, 55, 56, 57 and 58 of the control circle adjusters 28 and 29 and of the lifting devices 33 and 38 are controlled by a control unit 59.

A measuring bar 60 is associated with the control unit 59, and measures the vertical and horizontal bending of the roller carrier 22.

The amount of bending of the roller carrier 22 in the vertical plane is measured with five height sensors 61, 62, 63, 64, and 65, and in the lateral plane with five lateral sensors 66, 67, 68, 69 and 70.

The drive motors 54, 55, 56, 57, and 58, and also the height and lateral sensors 61, 62, 63, 64, 65, 66, 67, 68, 69 and 70 are connected with the control unit 59 by the connection lines 71, 72, 73, 74, 75, 76, 77, 78, 79, 80, 81, 82, 83, 84 and 85. The control unit 59 is supplied from an electricity system 86.

The tilting of the roller carrier in the vertical and horizontal planes is determined by the bending of the roller carrier 22 as determined by the height and lateral sensors 61, 62, 63, 64, 65, 66, 67, 68, 69 and 70.

The tilting motion of the roller carrier 22 in the vertical plane is generated by the drive motors 57 and 58, and in the lateral plane by the drive motors 54, 55 and 56. The drive motors 54 and 55 are connected synchronously.

We claim:

1. Machine for manufacturing from strip metal, spiral seam pipe having a longitudinal axis, comprising a stationary machine frame, a set of three forming rolls each carrying a large number of bending rollers, and bending rollers acting on the inside o the pipe being arranged on a pivotally supported inner roller carrier having a front end and a rear end, first control means for displacing and tilting the inner roller carrier (22) in a vertical plane, said first control means comprising suspension means having a lever (37) extending in a direction parallel to the longitudinal axis of the pipe to be produced, one end of said lever being pivotably connected by link means (36) to the roller carrier at a central position thereof, first lift means (33, 57) pivotably connected to the rear end of the roller carrier and second lift means (38, 58) pivotably connected to the other end of said lever, second control means for displacing and tilting the inner roller carrier in a horizontal plane, said second control means comprising a parallelogram linkage system (23) connected laterally to the roller carrier (22) and comprising two first adjustment links arranged in a first steering circle plane (**24*a*) and one second adjustment link (27) arranged in a second steering circle plane (24*b*), said adjustment links being each pivotably connected at one end to an eccentric pin pivotted in the stationary machine frame (90) and each having the other end thereof pivotably connected to the roller carrier, and drive means for the eccentric pins, a pivot rod (31) retaining the roller carrier (22**) parallel to the longitudinal axis of the pipe to be produced, said pivot rod being pivotably connected to the machine frame, and means for measuring deflection of the roller carrier during operation and for controlling said first and second lift means and said drive means.

2. Machine according to claim 1, wherein the two first adjustment links arranged in the first steering circle plane are located parallel to the longitudinal axis of the pipe to be produced forwardly of said one second adjustment link.

3. Machine as in claim 1 wherein, each eccentric pin (51, 52, 53) is coupled to a drive motor (54, 55, 56).

4. Machine as in claim 3 wherein each lift means (33, 38) is equipped with a drive motor (57, 58).

5. Machine as in claim 4, including a control unit (59) to control the drive motors (54, 55, 56, 57, 58).

6. Machine as in claim 5, wherein a measuring bar (60) is associated with the control unit (59) for measuring the vertical and horizontal deflection of the roller carrier (22).

* * * * *